United States Patent [19]

Bartelloni

[11] 4,445,972

[45] May 1, 1984

[54] PROCESS FOR THE CONTINUOUS MANUFACTURE IN AN AQUEOUS MEDIUM OF SHEETS MADE OF FIBROUS MATERIAL AND CONTAINING LATEX OR SIMILAR AND/OR PHENOPLASTS OR AMINOPLASTS, SHEETS OBTAINED BY SAID PROCESS AND THEIR POSSIBLE RE-USE

[75] Inventor: René Bartelloni, Lisle en Rigault, France

[73] Assignee: Papeteries de Jean d'Heurs, Bar le Duc, France

[21] Appl. No.: 349,366

[22] Filed: Feb. 16, 1982

[30] Foreign Application Priority Data

May 12, 1981 [FR] France ..... 81 09400
Jan. 8, 1982 [FR] France ..... 82 00224

[51] Int. Cl.[3] ..... D21H 3/32

[52] U.S. Cl. ..... 162/164.1; 162/164.3; 162/164.6; 162/169; 162/170; 162/189; 162/191

[58] Field of Search ..... 162/164.1, 168.1, 169, 162/183, 135, 158, 181.1, 168.2, 170, 168.3, 164.3, 164.6, 146, 157.2

[56] References Cited

U.S. PATENT DOCUMENTS 2,601,597 6/1952 Daniel et al. ..... 162/164.6
4,274,916 6/1981 Grose ..... 162/183

FOREIGN PATENT DOCUMENTS 6390 5/1980 European Pat. Off. .
1544330 7/1979 United Kingdom .

OTHER PUBLICATIONS

*Chemical Abstracts*, 93:30875b (1980).
*Chemical Abstracts*, 93:97203z (1980).
Alince, B. et al "Colloidal Aspects of the Retention of Positively Charged Additives" *Tappi*, vol. 61, No. 11, pp. 111–114 (Nov. 1978).

*Primary Examiner*—Peter Chin
*Attorney, Agent, or Firm*—Browdy and Neimark

[57] ABSTRACT

A new process for manufacturing sheets made of fibrous material containing latex is characterized in that the pulp containing the fibrous material is prepared in the following way:—adjustment of the pH between 4 and 5.5 and preferably between 4 and 4.5,—addition of an electrolyte, the polarity of which is of the opposite sign to that of the latex used,—addition of a foam inhibitor,—re-adjustment of the pH between 4 and 5.5, if necessary,—addition, preferably by injection, of latex-,—second addition of an electrolyte having the same characteristics as indicated above,—possibly addition of resins (phenoplasts or aminoplasts),—re-adjustment of the pH to the previously indicated value, if necessary.

The new sheets obtained by this process find use in the field of paper manufacture.

12 Claims, 2 Drawing Figures

PROCESS FOR THE CONTINUOUS MANUFACTURE IN AN AQUEOUS MEDIUM OF SHEETS MADE OF FIBROUS MATERIAL AND CONTAINING LATEX OR SIMILAR AND/OR PHENOPLASTS OR AMINOPLASTS, SHEETS OBTAINED BY SAID PROCESS AND THEIR POSSIBLE RE-USE

BACKGROUND OF THE INVENTION

The present invention relates to a novel process for the continuous manufacture in an aqueous medium of fibrous material sheets—and particularly of paper—containing latex and optionally phenoplasts or aminoplasts, and to sheets obtained by means of this process as well as their possible re-use.

The world requirement as regards special papers is increasing. This is particularly true for water resistant papers intended for the manufacture of abrasives, adhesives, artificial leathers, etc. It is principally polymeric materials which confer on these special papers their impermeability, their flexibility and their resistance, and it is principally the phenoplasts or aminoplasts which permit different appropriate coatings to be laid which the manufacture of these different special papers requires.

To produce these different special papers, the conventionally used procedure is generally as follows:

- the continuous sheet of fibrous material is wound normally during production thereof on a mandrel so as to form a reel.
- the reel obtained is then fed in a continuous length through another machine in one, two, three—or even more—passes, the purpose of which is to deposit on one or both faces of the fibrous material sheet different layers (latex, resins, etc.).

It is only then that the sheet, after appropriate drying, is again wound in a reel. That is to say that in order to obtain the desired paper, it is necessary to repeat the winding and unwinding operations a plurality of times, applying each time a new coat. That obviously considerably increases the cost price of a reel. It has not been possible up to present to operate in a single pass (e.g. by mixing the pulp—crude or refined—with latex) to obtain directly the desired paper. This is perhaps due to the presence of coagulated beads and deposits of latex (or resins) in the circuit using the mixture or in the machine manufacturing the sheet, which phenomena make rapidly impossible any continuous manufacture. This may be also due to the very poor retention of the latex and the resins on the fibrous material. Nevertheless, despite the evidence of a spectacular lowering of the cost price if the latex (or other additives) could be added into the body of the pulp in the papermaking machine, this simplification of manufacture has never yet been successfully implemented and recourse is always had to a plurality of long and costly passes.

The present invention has consequently as its aim to provide a new process for the continuous manufacture of fibrous materials containing an impermeabilizing agent such as latex, which answers better the requirements of practice than the previously known processes having the same aim, more especially in that it allows not only a whole series of coating steps to be left out by manufacturing the paper from fibrous materials containing latex in their mass but also a perfectly homogeneous paper to be obtained—more homogeneous and more even that that obtained by the previously known processes.

SUMMARY OF THE INVENTION

The present invention has as in object a process for the continuous manufacture in an aqueous medium of fibrous material sheets containing in their mass latex and optionally phenoplasts or aminoplasts, characterized in that the pulp containing the fibrous materials is prepared before it is fed into the manufacturing circuit and to the manufacturing table in the following way, while respecting the order given:

- adjustment of the pH between 4 and 5.5, and preferably between 4 and 4.5,
- addition of an electrolyte bridging agent the polarity of which is of the opposite sign to that of the latex to be used, whereby the electrolyte becomes attracted to and coats the surfaces of the fibres,
- addition of a foam inhibitor,
- re-adjustment of the pH between 4 and 5.5, if necessary,
- addition, preferably by injection, of the latex, which becomes attracted to and coats the electrolyte on the surface of the fibres,
- second addition of electrolyte (having the same characteristics as indicated above),
- possibly addition of resins (phenoplasts or aminoplasts), and
- re-adjustment of the pH to the previously indicated values, if necessary.

In accordance with the invention, the fibrous material may be formed of paper, i.e. wood, pulp and/or glass fibers and/or synthetic fibers and/or textile fibers.

The process described in the present invention is more particularly adapted to the manufacture of papers whatever the starting pulp: mechanical pulp, semi-chemical pulp, chemical pulp, unbleached chemical pulp, bleached chemical pulp, soda pulp, sulfate pulp, kraft pulp, bisulfite pulp, rag pulp, steeped straw pulp, bleached straw pulp etc. These listed pulps are all formed largely of cellulose fibers.

Continuing the study of different operating conditions and more especially the physical, chemical, physico-chemical parameters, the quality of the raw materials and the problem of recuperation, the applicant has succeeded in making a whole series of improvements and changes for the better resulting in the formation of fibrous mixtures of exceptional quality, not only in the field of industrial and medical adhesive papers, but also in the field of very highly refined papers going up to a draining index reaching 95° SR (SCHOPPER-RIEGLER method).

According to one particularly advantageous embodiment of the process of the present invention, the polyelectrolyte bridging agent used is a polyelectrolyte with a high molecular weight, greater than 15,000, at a very positive potential and the latex used is in the form of finely divided suspension stabilized at an acid pH between 4 and 5 and preferably between 4.2 and 4.5.

It was precisely while examining the development of the electrostatic charges of the fibrous mixtures that the applicant discovered that by using, on the one hand, a highly positive potential polyelectrolyte bridging agent and, on the other hand, fine latex particles stabilized at an acid pH, the internal cohesion of the prepared material is provided by extremely fine reticulation or linking of the latex molecules on the fibrous materials, thus forming an intimate bridge between the two elements (fiber and latex) through the polyelectrolyte which acts as a binding, linking or bridging agent. This reticulation is remarkably homogeneous and very reliably reproducible. It is this reticulation which confers on the fibrous sheets of the present invention their properties which differ completely from those of sheets containing latex prepared according to the process of the prior art (cf for example French Pat. Nos. 2 388 915, 2 429 291, 2 357 676, 2 447 420).

According to an advantageous embodiment of the process of the present invention, the latex used is natural latex.

According to another advantageous embodiment of the process of the present invention, the latex used is an artificial latex (chlorobutadiene polymer or acrylic latex in particular).

In accordance with the invention, the latex solution used has a solids content between 5 and 50%, and preferably between 7 and 15%, its viscosity (Brookfield) is between 30 and 650 centipoises at 25°, and the amount of latex is between 3 and 75% (dry product) with respect to the total dry weight of the fibrous materials.

According to an advantageous embodiment of the process of the invention, the diameter of the particles of divided latex is between 0.01 and 0.5$\mu$ and preferably between 0.1 and 0.2$\mu$.

According to an advantageous embodiment of the invention, the polyelectrolyte solution used has a solids content between 0.2 and 10% and the amount introduced into the fibrous material suspension is between 0.1 and 3.5% of the dry product with respect to the total dry weight of the latex for the first addition and between 0.1 and 2% of the dry product with respect to the total dry weight of the fibrous materials for the second addition.

In accordance with the invention, the foam inhibiting solution has a solids content between 2 and 20%, and the amount added to the total mixture is between 0.05% and 0.25% of the total dry weight of the fibrous materials.

In accordance with the invention, the phenolic (or aminoplast) resin solution has a solid material content of about 50 to 85%, a viscosity (Brookfield) between 5 500 and 7 000 centipoises and the amount added to the mixture (dry product) is between 0.01 and 50% with respect to the total dry weight of the fibrous materials.

According to a particularly advantageous embodiment of the invention, the fibrous material further contains, in its mass, dyes and pigments and/or fungicides and/or insecticides and/or fireproof products and/or sizing agents and/or an inert mineral charge.

In accordance with the invention, there may be applied during manufacture of the fibrous material sheet, on one or both faces of said sheet, different products selected from the group which comprises: starches, carboxymethylcellulose, acrylic suspensions, polyvinyl alcohols, fireproof agents, fungicides, insectides, dye materials, barriers to organic solvents, sizing agents, magnetic coating agents, mineral and organic charges.

All these applications are made possible precisely because of the simplification of the process of the invention, which allows latex to be added into the mass of the fibrous material.

In accordance with the invention, the fibrous material used is a fibrous material having a pulp base recycled from old papers, the latex added is formed by a mixture of ethylacrylate and acrylonitrile copolymers and its proportion with respect to the dry weight of the fibrous materials is between 40 and 55%.

The process of the present invention allows papers of excellent quality to be obtained complying with the standards and criteria of normal use, while starting from pulp recycled from old papers. This may be obtained because especially of the presence of fine particles of reticulated, i.e. linked latex and because of the possibility of being able to subject the sheet, after formation thereof in the so-called "wet" part of the manufacture, to different treatments and applications and in particular the application of:

starches (solubilized or insolubilized),
carboxymethylcelluloses (solubilized or insolubilized),
acrylic suspensions of all kinds,
polyvinyl alcohols (solubilized or insolubilized),
barrier solutions to organic solvents,
natural or synthetic sizing agents,
bonding products, etc.

As an example of special treatment (valid not only for papers of current manufacture but also for old paper based pulps), the treatment conferring on papers adhesive properties may be more especially mentioned.

Adhesive papers (medical, industrial, technical) are at present manufactured from a paper base of 50 to 160 g/m$^2$. This base is impregnated with a polymer or copolymer or a mixture of polymers (generally styrene based) in one or more passes. When this operation is finished, this impregnated paper base undergoes two operations carried out in a solvent medium:

deposition on a face of the base of an anti-adhesive layer allowing the subsequent winding into a reel and unwinding of the finished product for use,
deposition on the other face of the initial base and, in another machine, of an adhesive layer.

The applicant has discovered that the process in accordance with the present invention allows anti-adhesive layers to be applied in an aqueous medium. This facility is considerable, for the introduction of solvents in paper manufacturing shops has posed serious problems.

In accordance with the present invention, the layer of anti-adhesive material is formed by an aqueous suspension of carboxymethylcellulose in an amount between 0.01 and 10% and brought for 5 to 25 minutes to 90°95° C.

According to a particularly advantageous embodiment of the present invention, the carboxymethylcellulose suspension further contains from 0.01% to 85% of polyester and/or from 0.01% to 75% of an anionic or non-ionic potential silicon emulsion stabilized in an aqueous medium at a pH between 5 and 6.

The present invention also relates to fibrous material sheets obtained in accordance with the process of the invention. The paper thus obtained and which may serve for numerous industrial uses (abrasive papers, adhesive papers, tear-proof papers for bags, posters, etc. papers for preparing artificial leather, papers for book covers, papers for impermeable envelopes, papers for manufacturing bags for vacuum cleaners, etc.), has excellent mechanical characteristics which class it among the best, and this more especially because of its rupture length, its resistance to bursting, its resistance to breakage by pulling, its thermoformability, its high resistance to use in aqueous media, its resistance to repeated folding, etc.

Another extremely important characteristic of the paper of the invention is its homogeneity revealed with the electron microscope and which clearly distinguishes it from all the other papers at present on the market.

The present invention relates to the re-use and the recuperation of the fibrous materials obtained in accordance with the described process. One of the advantages and not the least of the process of the present invention resides in the possibility of being able to recycle relatively easily any fibrous material obtained in accordance with the present invention, and this contrary to all the papers containing latex and prepared in accordance with the process of the prior art.

This repulpability and recycling operation is characterized in that it is carried out in an aqueous medium, in the cold state, in the presence of a wetting agent and in the presence of a small quantity (0.01 to 0.15% with respect to the volume of water and 0.2 to 1.5% with respect to the weight of dry fibrous materials) of chloride ions and/or of sulfate ions and/or of sulfamate ions. It is of course the extremely fine reticulation of the latex molecules on the fibrous material which explains the easy repulpability of the papers prepared in accordance with the present invention. In other words, addition of any of the aforementioned ions serves to cleave the linkage of the fine latex particles to the fibers created by the polyelectrolyte. Consequently, it will be understood that during the manufacture of the paper the presence of substantial quantities of such ions or other ions which similarly effect cleavage should be avoided in the furnish.

Besides the preceding arrangements, the invention further comprises other arrangements which will appear from the following description.

The present invention relates more particularly to the process and the installations for manufacturing fibrous material sheets (and more especially paper) containing, in their mass, latex or the like and optionally phenoplasts or aminoplasts and the fibrous material sheets thus obtained as well as the means adapted for implementing these processes, likewise the overall processes and the manufacturing chains in which the processes and installations in accordance with the present invention are included.

The invention will be better understood from the complement of description which follows which refers to examples of implementing the process of the present invention by means of the installation shown schematically by way of non limiting example in the accompanying drawings, to an analytical experimentation report and to a recycling installation shown schematically in the accompanying drawings.

Figure 1:
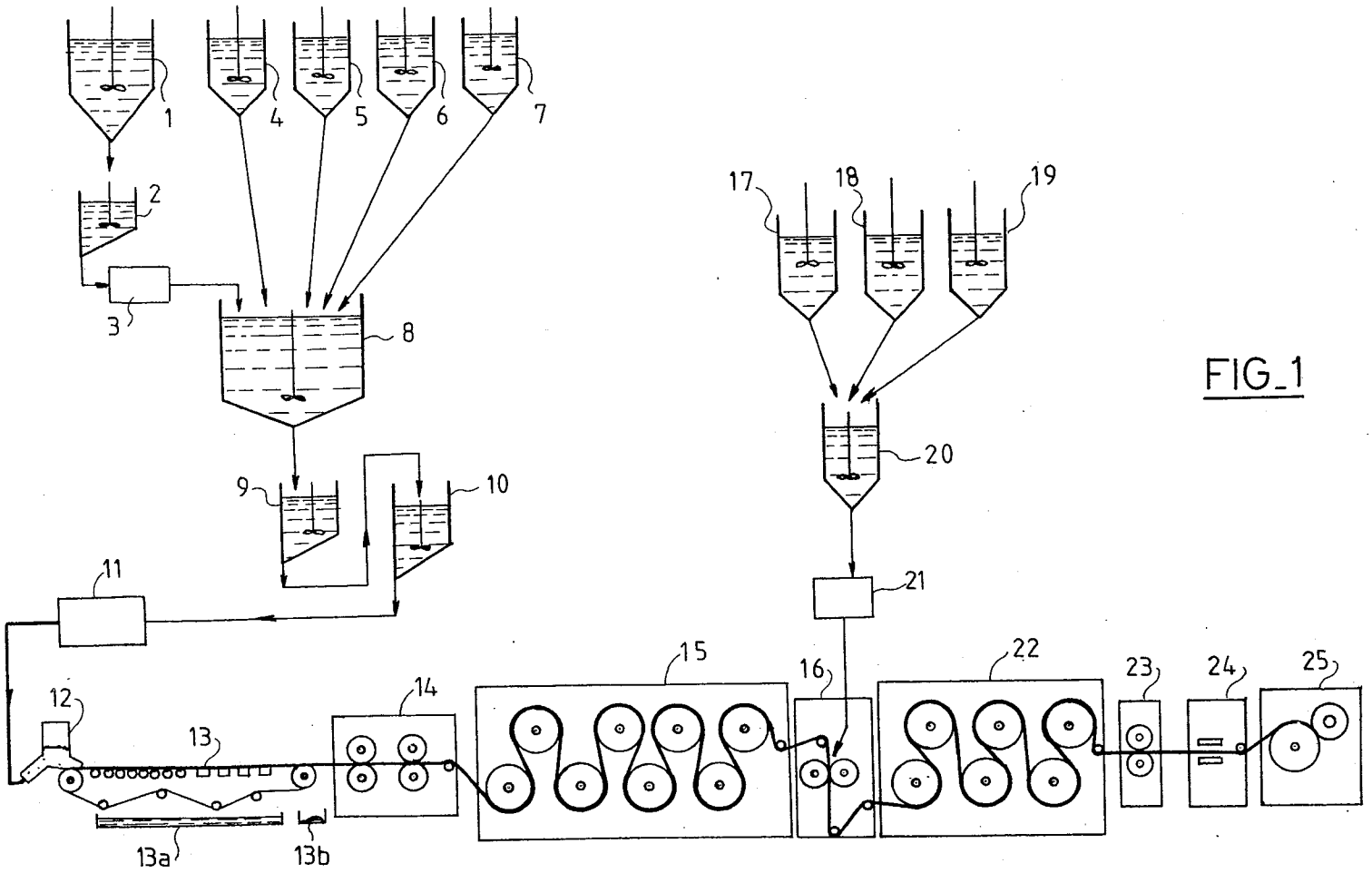
FIG. 1 is a schematic view illustrating a method according to the invention.

It should however be understood that these examples, report and installation are given solely by way of illustration of the object of the invention, of which they in no wise form a limitation.

EXAMPLES OF PREPARATION

Example 1: Preparation of paper containing latex in its mass

Fibrous material coming from a pulp factory is introduced into tank 1 in the presence of water and dye material if necessary, and it undergoes therein appropriate agitation for putting the fibrous particles into suspension. The solids content of the mixture is adjusted to about 2 5%. The fibrous suspension prepared is fed into storage tank 2, then into section 3 for so-called refining and hydration of the fibrous, so that the fibrous material undergoes the structural modifications required for subsequent formation into sheets. In the particular case of paper, the structural modification confers on the mixture a draining index according to the SCHOPPER-RIEGEL method between 10° and 50° SR.

The fibrous material prepared in this way is then fed into the mixing tank 8.

Meanwhile, the following reagents and raw materials are prepared:

(a) latex of an anionic character (or an acrylic suspension) with a Brookfield viscosity between 30 and 650 centipoises having a high film-forming power from 0° C., is introduced into tank 4 provided with adequate agitation, to undergo therein an aqueous dilution for forming a solution whose solids content is between 5 and 50%.

(b) In tank 5, having an appropriate agitation and heating means (coil or double casing for example), an aqueous solution is prepared of a polyelectrolyte bridging agent having a polarity opposite that of the latex (of cationic character in the present case: for example a water-soluble polyamine). The solids content of the preparation must be between 0.2 and 10%.

(c) Tank 6 having appropriate agitation serves for preparing an aqueous solution of a foam-inhibiting product. The dilution is adjusted so that the solids content is between 2 and 20%.

(d) Tank 7 having appropriate agitation is used for storing a resin solution (phenoplasts or aminoplasts) containing between 55 and 85% of solid materials and having a Brookfield viscosity between 5500 and 7500 centipoises (at 25° C.)

The procedure is then as follows:

The fibrous material previously prepared and introduced into tank 8 is brought under agitation to a pH between 4 and 5.5, preferably between 4 and 4.5 by addition of an acid which may be hydrochloric acid, sulfuric acid or alumina sulfate. The electrolyte solution prepared in tank 5 is introduced into the fibrous mixture in tank 8 under agitation, in a proportion between 0.1 and 3.5% of dry product with respect to the total dry weight of latex used in the following step, and more particularly between 0.5 and 2.5%. The foam inhibiting solution prepared in tank 6 is incorporated in the mixture in tank 8, under agitation, in a ratio of dry product of 0.05 to 0.25% of the total dry weight of fibrous materials. The pH is then readjusted, if necessary, to the above indicated values. The latex solution prepared in tank 4 is then added by injection into the mixture in tank 8 under appropriate agitation, in a proportion preferably between 3 and 60% of dry product with respect to the total dry weight of fibrous materials. To the mixture thus obtained in tank 8 it is advisable to add, under appropriate agitation, a complementary amount of the electrolyte prepared in tank 5, between 0.01 and 2% of dry product with respect to the total dry weight of fibrous materials, so as to ensure the deposition and complete fixing of the latex on the fibrous material used. The phenolic resin solution stored in tank 7 is then introduced under slow agitation into the mixture in tank 8, in a proportion of dry product between land 50% with respect to the total dry weight of fibrous materials. The pH of the final mixture thus obtained in tank 8 is then readjusted, if necessary, to the above-mentioned values. The whole of the preparation is then conveyed to storage tank 9, then to tank 10 feeding the manufacturing circuit of a machine for manufacturing a continuous paper band.

The suspension contained in tank 10 undergoes continuously in section 11 an aqueous dilution bringing the total solids content of the mixture, a distribution point 12, to a value between 0.2 and 1.5%. Distribution point 12 continuously feeds the sheet-forming section 13 usually called "wet part", in which the sheet is formed by elimination of the water from the mixture through a rotating metal (or plastic) cloth. The water drained, then drawn by vacuum is recovered at point 13*a* to be recycled at 1 and 11. The sheet calibrated in width at the end of part 13 is conveyed to pressure drying section 14, whereas the excess width or clippings is recovered at point 13*b* to be recycled to storage tank 9. The sheet continuously formed in this way is then directed into the drying section 15 in which each face of the sheet is dried alternately by means of a battery of drying drums. The solids content of the sheet on entering the drying section 15 is generally between 25 and 50%. After drying in section 15, the sheet may be fed, if so desired, into a coating section 16 where different products, or simply water, may be applied to one or both faces. In the particular case of paper manufacture, the usual name for this coating equipment may be, by way of non limiting examples the size-press, the different process for coating on one or both faces such as champion, air blade, trailing blade systems etc. Passing the sheet during continuous manufacture through this coating section is optional. It may be used for providing complementary properties, particular and specific to the products used in this section and for creating new materials from a continuous sheet containing in its mass fibrous materials, latex or acrylic suspensions, phenolic resins. By way of non limiting examples, the products below may be used in section 16 after appropriate preparation in tank 17, 18, 19, proportioned, mixed or not in tank 20, filtered and diluted adequately in section 21:

soluble or insolubilized starches of all kinds,
soluble or insolubilized carboxymethylcelluloses,
acrylic suspensions,
polyvinyl alcohols,
solutions for fireproofing, fungicide, insecticide treatment,
dye materials,
barrier solutions to organic solvents in general,
synthetic sizing agents,
magnetic coating,
mineral charges,
synthesis products, etc.

If it passes through section 16, the sheet is then dried again, simultaneously on each face, in section 22. If this optional treatment in section 16 is not used, the sheet passes directly from section 15 to section 22. On leaving section 22, the sheet may be engaged in section 23, with a view to conferring thereon complementary or particular properties by a thickness calibrating, embossing or surfacing treatment. The sheet may also be engaged in section 24 where it undergoes high temperature radiation for ensuring, if necessary, complete polymerization of the materials forming it.

As for the treatment in section 16, the treatments in section 23 and/or 24 are optional, but these complementary operations may provide properties for special uses. If sections 23 and/or 24 are not used, the sheet is fed directly into section 25 where it is wound on a reel.

Example 2: preparation of a support paper for abrasives

This paper contains (expressed in percentage of dry product):

76.3% of bleached resinous wood fibers,
0.35% of electrolyte of a cationic character,
0.10% of foam inhibitor,
20% of latex of an anionic character,
3.25% of phenolic resin.

This paper sheet is prepared continuously, as described in example 1, however without passing through section 16, but passing through section 23 for calibration, then directly to section 25.

Example 3: preparation of a printable support paper for abrasives

This paper contains (expressed in percentage of the dry product):

75% of bleached resinous wood fibers,
0.30% of cationic electrolyte,
0.10% of foam inhibitor,
20% of anionic latex,
3.20 of phenolic resin,
1% of oxidized maize starch,
0.20% of urea-formol,
0.20% of sizing agent.

This paper is prepared with passage through sections 16–22-23–25.

Example 4: Preparation of a support paper for adhesives

This paper contains (expressed in percentage of the dry product):

73% of bleached resinous wood fibers,
26.5% of anionic latex,
0.45% of cationic polyelectrolyte,
0.05% of foam inhibitor.

This paper is prepared in accordance with the process described in example 1, with direct passage from section 15 to section 25.

Example 5: preparation of a printable support paper for adhesives

This paper contains (expressed in percentage of the dry product):

70% of bleached resinous wood fibers,
28.3% of anionic latex;
0.45% of cationic electrolyte,
0.05% of foam inhibitor,
0.20% of urea-formol,
1% of oxidized maize starch.

This paper is prepared in accordance with the process described in example 1, with passage through section 16–22–25

Example 6: preparation of a paper for manufacturing bags for vacuum cleaners

This paper contains (expressed in percentage of the dry product):

48.5% of unbleached resinous wood fibers,
48.5% of bleached resinous wood fibers,
2.85% of anionic type latex,
0.15% of cationic type electrolyte, This paper is prepared according to the process described in example 1 with passage through the following section:

Section 15—section 22—section 25

Example 7: preparation of a paper for manufacturing tear-proof envelopes

This paper contains (expressed in percentage of the dry product):

63% of bleached resinous wood fibers,

36% of anionic type latex,

1% of cationic type electrolyte.

This paper is prepared as described in example 6.

Example 8: preparation of a paper with an anti-adhesive layer

The procedure is as described in examples 4 and 1, with passage through the following sections:

1 to 15, then 16–22–23–25

The product, before entering section 16, has for example the following composition (expressed as dry product):

73% of bleached resinous wood fibers, 26.5% of an ethylacrylate and acrylonitrile complex stabilized at a pH of 4.2 to 4.5

0.45% of high molecular weight polyamine (e.g. the polyelectrolyte sold under the tradename "Primafloc C-3" by the ROHM and HAAS firm.

0.05% of foam inhibitor.

The anti-adhesive formulation is prepared in tank 17 in the following way:

a dose of powdered or granulated carboxymethylcellulose is introduced under agitation into water so as to form a solution in which the content (expressed as dry product) is between 0.05 and 5%. Then this solution is brought up to a temperature of 90°–95° C. and this temperature is maintained for about 20 minutes and then it is allowed to cool.

An aqueous silicon emulsion stabilized beforehand at a pH of 5.2 is then poured into tank 18 contained water until a silicon concentration of about 20% is obtained.

In tank 19, an aqueous solution is prepared containing about 20% (expressed as dry paterial) of polyester emulsion stabilized beforehand at a pH of 5.4, which emulsion has a Brookfield viscosity (at 25° C.) between 200 and 1000 centipoises.

The three solutions (17, 18, 19) being prepared, they are mixed in tank 20 in the following way:

80–120 parts of solution 17

2–15 parts of solution 18

2–25 parts of solution 19

The dry extract of the solution contained in the tank is between 2 and 8%.

This solution thus obtained is deposited on a single face of the paper which, after passing through sections 22–23–25, has the following composition:

| | |
|---|---|
| bleached resinous wood fibers | 71% |
| acrylic copolymer | 26% |
| polyelectrolyte | 0.43% |
| foam inhibitor | 0.04% |
| anti-adhesive material (deposited on a single face) | 2.53% |

Example 9: recuperation of used paper

Figure 2:
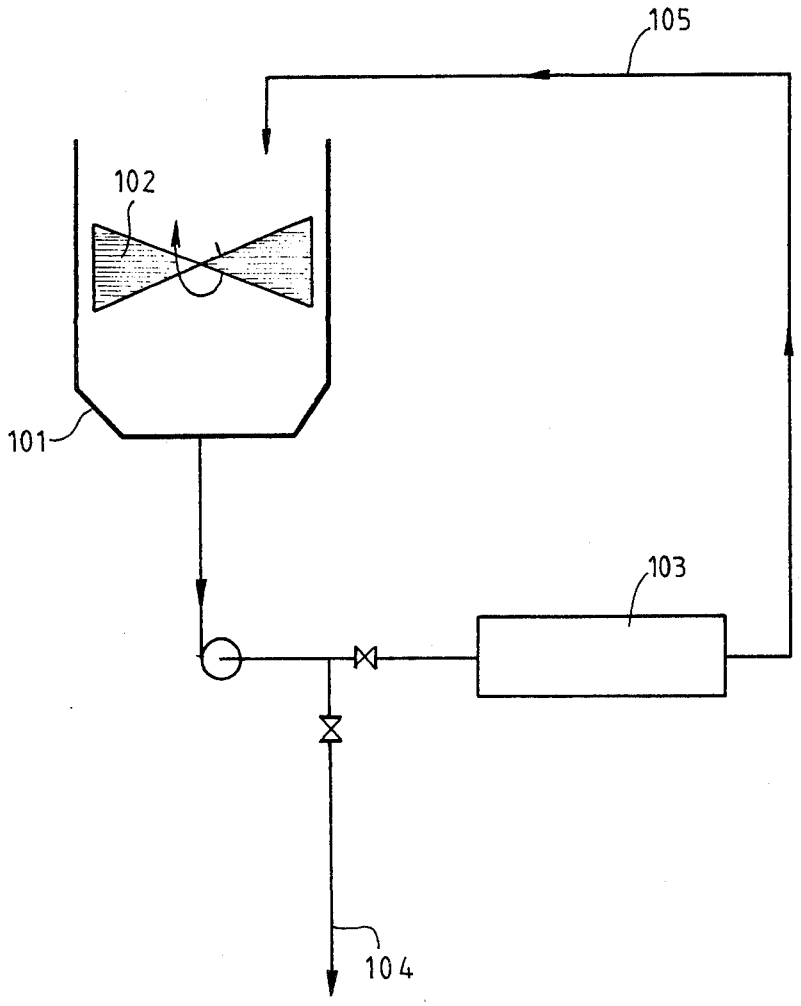
FIG. 2 is a view illustrating a method for repulping and recycling paper according to the invention.

The installation required for recycling old latex based papers is shown schematically in FIG. 2.

Into tank 101 containing 2000 liters of water contained 0.1% of bleach p/volume, are introduced 500 kg of waste and clippings of a paper which has for example the following composition:

| | |
|---|---|
| unbleached resinous wood fibers | 45.5% |
| bleached resinous wood fibers | 45.5% |
| latex | 8.85% |
| polyelectrolyte | 0.15% |

The agitator is started up and agitation is carried out until about 80% of the paper is reduced to fragments. This reduction to fragments is checked by the usual checking processes in paper-making. At this stage, there still remains some very fine agglomerates called in paper-making jargon "buttons" or "pellets". The mixture thus obtained is then fed into a breaking up apparatus 105 called "pellet reducer" (e.g. a pellet reducer sold under the trademark "Hydraflaker" by BLACK CLAWSON), while recycling the liquor through piping 105 towards tank 101.

For this operation the repulping time in tank 101 has 25 minutes, pellet reduction time 15 minutes, i.e. a total of 40 minutes for making the 500 kg of fibrous material re-usable which are then sent for re-use through piping 104.

Example 10: recovery of used paper having a very high latex content

Composition of the starting paper:

| | |
|---|---|
| bleached resinous fibers | 51.2% |
| ethylacrylate/acrylonitrile type latex | 45% |
| polyelectrolyte | 1.8% |
| synthetic sizing agent | 0.20% |
| phenoplasts | 2% |
| carboxymethylcellulose | 0.8% |

The procedure is as described in example 2, but 0.5% of bleach p/volume is introduced. The repulping time was 40 minutes and the pellet reduction time was 15 minutes, i.e. 55 minutes for the 500 kg of material used. The raw material thus recovered is re-used in manufacturing a conventional printing-writing paper base at the rate of 10% dry product with respect to the total dry weight of the manufactured base.

ANALYTICAL EXPERIMENTATION REPORT

The following tables resume the principal characteristics of the products obtained in accordance with the proces of the present invention (examples 9 and 10), with respect to commercial products containing latex.

Table I shows the mechanical characteristics and table II the characteristics of a paper in which a recycled pulp based fibrous material has been used:

TABLE I

COMPARISON OF THE MECHANICAL CHARACTERISTICS

| Tests | Material of the present invention | Commercially available material |
|---|---|---|
| Weight/m$^2$ | 149.5 | 147 |
| Bursting force (kg/cm$^2$) | 5.0 | 4.5 |
| Breaking load (in kg) | | |
| *SM | 13 600 | 11 800 |
| **ST | 6 500 | 9 900 |
| Breakage length (in meters) | | |
| SM | 6 060 | 5 350 |
| ST | 2 900 | 4 490 |
| Tear strength (in kg) | | |

TABLE I-continued

COMPARISON OF THE MECHANICAL CHARACTERISTICS

| Tests | Material of the present invention | Commercially available material |
|---|---|---|
| SM | 107 | 82 |
| ST | 134 | 87 |
| Amount of latex | 28% | 50% |

*SM : travelling direction
**ST : crosswise direction

An examination of the figures given in table I shows that the mechanical qualities of the paper in accordance with the invention are superior, and this even for a proportion of latex less than 50% with respect to the proportion of a paper available commercially. The papers obtained in accordance with the process of the present invention have not only excellent strength, but their printability as coated paper sheets is quite good, not only in so far as their aspect is concerned but also in so far as their ability to take ink, their clarity and their reproduction of colors are concerned.

TABLE II

| | Product of the invention, | Convention products commercially available | |
|---|---|---|---|
| | latex amount 20% basic raw material 100% old recycled papers | raw material 100% noble pulp | raw material 100% old papers |
| Weight per $m^2$ (in grammes) | 88.6 | 90 | 83 |
| Thickness in | 108 | 105 | 160 |
| Bursting index | 29.5 | 22 | 12.5 |
| Porosity BENDTSEN ml/min | 250 | 160 | 1200 |
| Bursting strength kg:$cm^2$ | 2.6 | 2 | 1.0 |
| Breaking load (in kg) | | | |
| SM | 8 | 8.1 | 3 |
| ST | 4 | 4.3 | 1.8 |
| Breaking length (in meters) | | | |
| SM | 6020 | 6000 | 4800 |
| ST | 3010 | 3200 | 2400 |
| Tear index | | | |
| SM | 78 | 60 | 58 |
| ST | 73 | 63 | 59 |

Table II reflects the particularly advantageous qualities obtained by the process of the present invention, with respect to basic fibrous materials formed exclusively from pulp recycled from old papers.

It follows from the preceding description that, whatever the mode of implementation, embodiments and mode of application adopted, a process is obtained for continuously preparing fibrous material sheets containing in their mass latex or similar and/or phenoplasts or aminoplasts which presents, with respect to previously known processes relating to the same purpose, important advantages such as the advantages of providing by a simple and economical method papers of excellent quality for numerous industrial uses, and more especially papers for abrasives in a dry or aqueous medium, support papers for adhesives, support papers for artificial leathers, support papers for book covers, papers for albums, papers for tear-proof posters, advertising papers, papers for adhesive labels and for self-adhesives in general, support papers for metalization, support papers for washable wallpapers, papers for vacuum cleaner bags, papers for filtering, papers for books, documents, reviews subject to heavy and frequent handling, papers for manufacturing bank notes, papers for thermo-forming in general and all paper supports requiring high resistance to tearing, folding, wear, water, while retaining a very great flexibility as well as high mechanical strength.

Besides these advantages, two other very important advantages should be mentioned, namely:

the advantage of presenting a draining time of the fibrous matress on a sheet forming cloth of a papermaking machine less than 15 seconds and even, under certain conditions, between 4 and 10 seconds, the advantage of retaining all the latex (or similar) used by complete reticulation on the fibrous material used, thus ensuring total absence of latex particles not fixed in the draining water, thus avoiding any excess consumption of raw material and the whole problem of cleaning manufacturing circuits or pollution of the effluents of the factory.

Thus, as is clear from the above, the invention is in no wise limited to those of its modes of implementation, embodiments and modes of application which have just been described more explicitly; it embraces, on the contrary all variations thereof which may occur to a man skilled in the art without departing from the scope or spirit of the present invention.

What is claimed is:

1. A method for the continuous manufacture of fibrous paper sheet material from an aqueous pulp containing latex, comprising:

(a) providing an aqueous suspension of fibers having an anionic charge, (b) providing an aqueous suspension of finely divided latex particles, having an anionic charge stabilized at a pH between 4 and about 5, the amount of latex in the dry state being between 3 and 75% with respect to the total weight of fibrous material, the diameter of the latex particles being between 0.01 and 0.5 microns;

(c) adding to the aqueous suspension of fibers prepared in step (a), a polyelectrolyte having a molecular weight greater than 15,000, and a cationic charge, said polyelectrolyte being used in the form of a solution containing between 0.2 and 10% by weight of polyelectrolyte and the amount of polyelectrolyte added to the aqueous suspension of fibers being between 0.1 and 3.5% with respect to the total dry weight of the latex, to be added later, (d) avoiding the presence in the aqueous medium of substantial amounts of ions which will cause cleavage of bonds created by the polyelectrolyte between the latex particles and the fibers, said ions including chloride ions, sulfate ions and sulfamate ions, (e) adjusting the pH of the obtained mixture to a value between 4 and 5.5, (f) adding to the obtained mixture the aqueous suspension of latex prepared in step (b) thereby depositing the latex particles on the polyelectrolyte coated fibers while maintaining the particle size of the latex at approximately 0.01 to 0.5 microns, and (g) forming the sheet from the aqueous mixture formed in step (f).

2. Method according to claim 1, wherein the pH value is adjusted in steps (a) and (d) to between 4 and 4.5 and in step (b) to between 4.2 and 4.5.

3. Method according to claim 1, wherein the aqueous suspension of latex particles is added by injection to the mixture obtained in step (d).

4. Method according to claim 1, wherein the polyelectrolyte is a polyamine having a molecular weight greater than 15,000.

5. Method according to claim 1, wherein a second amount of polyelectrolyte is added to the mixture after addition of the suspension of latex particles and the pH is readjusted if necessary to the previously indicated values, and wherein the second amount of polyelectrolyte added to the mixture is between 0.1 and 2% of dry product with respect to the total dry weight of fibrous materials.

6. Method according to claim 1, wherein the latex used is selected from the group consisting of chlorobutadiene polymer latex, acrylic latex and natural latex.

7. Method according to claim 1, wherein the latex solution used has a solids content between 5 and 50% and preferably between 7 and 15%, and its viscosity (Brookfield) is between 30 and 650 centipoises at 25°.

8. Method according to claim 1, wherein the diameter of the latex particles is between 0.1 and 0.2μ.

9. Method according to claim 1, wherein the fibrous material used is a fibrous material with a pulp base recycled from old papers, the latex added is formed by a mixture of ethylacrylate and acrylonitrile copolymers and its proportion with respect to the dry weight of the fibrous materials is between 40 and 55%.

10. A homogeneous paper sheet comprising (1) fibers selected from the group consisting of cellulose fibers, synthetic fibers, textile fibers and mixtures thereof, which fibers in pulp form have an anionic charge;

(2) a polyelectrolyte bridging agent having a cationic charge, said bridging agent being attached to and fixed to said fibers by means of the opposite charges of said bridging agent and said fibers; and (3) fine latex particles of substantially 0.01–0.5μ, which latex particles have an anionic charge, being attracted to and homogeneously fixed to the polyelectrolyte fixed to the fibers by means of the opposite charges of said fine latex particles and said polyelectrolyte bridging agent, the amount of said latex particles being between 3% to 75% with respect to the weight of said fibers, the amount of said polyelectrolyte bridging agent being substantially between 0.1% and about 3.5% relative to the weight of latex particles and sufficient to insure complete fixing of the latex particles on the fibers, said homogeneous paper sheet being repulpable in an aqueous medium in the presence of a small quantity of ions selected from the group consisting of chloride, sulfate and sulfamate so as to provide a re-dispersed aqueous mixture of latex and pulp.

11. A process for repulping the paper sheet made in accordance with claim 1, comprising:

repulping the sheet in an aqueous medium containing 0.2 to 1.5% based on the weight of dry fibrous materials, ions selected from the group consisting of chloride, sulfate, sulfamate and mixtures thereof.

12. A homogeneous paper sheet according to claim 10, which paper sheet is porous, said fibers being cellulose fibers, and said small quantity of ions capable of causing redispersion of said paper into an aqueous mixture of latex and pulp comprising about 0.2 to 1.5% of said ions with respect to the weight of dry fibrous materials.

* * * * *